US005541844A

United States Patent [19]

Ibaraki et al.

[11] Patent Number: 5,541,844

[45] Date of Patent: Jul. 30, 1996

[54] ARITHMETIC UNIT FOR DETERMINING A TARGET POSITION FOR A THROTTLE OF AN INTERNAL COMBUSTION ENGINE

[75] Inventors: Toshikazu Ibaraki, Susono; Naoto Kushi, Toyota, both of Japan

[73] Assignee: Toyota Jidosha Kabushiki Kaisha, Toyota, Japan

[21] Appl. No.: 493,057

[22] Filed: Jun. 21, 1995

Related U.S. Application Data

[63] Continuation of Ser. No. 247,369, May 23, 1994, abandoned.

[30] Foreign Application Priority Data

May 21, 1993 [JP] Japan ..... 5-142852

[51] Int. Cl.[6] ..... F02D 1/16

[52] U.S. Cl. ..... 364/431.04; 364/424.01; 364/431.03

[58] Field of Search ..... 364/431.04, 426.03, 364/426.02, 426.04, 424.01, 431.01, 431.03; 180/197

[56] References Cited

U.S. PATENT DOCUMENTS

| | | | |
|---|---|---|---|
| 4,843,552 | 6/1989 | Inagaki | 364/426.03 |
| 4,951,208 | 2/1990 | Etoh | 364/426.03 |
| 4,969,102 | 11/1990 | Tamura et al. | 364/426.03 |
| 5,105,360 | 4/1992 | Akiyama | 364/426.03 |
| 5,107,948 | 4/1992 | Yamamoto | 180/197 |
| 5,124,922 | 6/1992 | Akiyama | 364/426.02 |
| 5,279,382 | 1/1994 | Iwata | 180/197 |

FOREIGN PATENT DOCUMENTS

| | | |
|---|---|---|
| 61-190138 | 8/1986 | Japan . |
| 2-221650 | 9/1990 | Japan . |

*Primary Examiner*—Kevin J. Teska
*Assistant Examiner*—Dan Fiul
*Attorney, Agent, or Firm*—Kenyon & Kenyon

[57] ABSTRACT

The present invention refers to a map for operation. The map of the invention represents an absolute value TDST of a difference between a first valve opening ratio TAM of a main throttle valve (35) and a second valve opening ratio TAS of a sub-throttle valve (37) plotted against a restriction value TA, which is the smaller of TAM and TAS. A conventional map requires a high precision around a line of TAM=TAS, that is, in the whole area of the map. The map of the invention, on the other hand, requires a high precision only in a specific range of the absolute value TDST, and allows sparse graduations of the map in an area other than the specific range. This effectively reduces data volume of the map and allows quick reference of the map. More specifically, the present invention determines a corresponding single-valve opening ratio TAA of a dual-valve throttle unit according to the first valve opening ratio TAM of the main throttle valve (35) and the second valve opening ratio TAS of the sub-throttle valve (37) by referring to the map. This method can reduce data volume of the map with out lowering the precision of operation.

10 Claims, 10 Drawing Sheets

TA=min (TAM, TAS)
TDST=|TAM−TAS|

ARITHMETIC UNIT FOR DETERMINING A TARGET POSITION FOR A THROTTLE OF AN INTERNAL COMBUSTION ENGINE

This application is a continuation of application Ser. No. 08/247,369, filed on May 23, 1994, now abandoned.

BACKGROUND OF THE INVENTION

1. Field of the Invention

The present invention relates to an arithmetic unit for vehicles and a method of operation thereof, and more particularly to an arithmetic unit and method of operation for determining a target amount. The target amount is correlated with two parameters related to the control of an internal combustion engine so that, in a specific region in the vicinity of an area in which the two parameters have a predetermined proportional relationship, the target amount is significantly varied as either of the two parameters is varied. In a region other than the specific region, the target amount is fixed or is varied depending mainly upon only one of the parameters. The present invention also pertains to a throttle valve opening ratio computing device, as an example of the arithmetic unit, for determining a corresponding single-valve opening ratio based on a first throttle valve opening ratio and a second throttle valve opening ratio of a dual-valve type throttle valve.

2. Description of the Related Art

A variety of known arithmetic units for vehicle systems determine a target amount required for control of the vehicle system according to two parameters. In such arithmetic units, a map is prepared and referred to for determining one target amount based on two parameters.

In a dual-valve throttle unit, for example, a target amount (for example, a valve opening ratio of a second throttle valve to be controlled) is determined according to two parameters (for example, a valve opening ratio of a first throttle valve and a corresponding single-valve opening ratio) for the purpose of traction control. FIG. 1 is a graph showing a map representing the correlation of a corresponding single-valve opening ratio TAA with a first throttle valve opening ratio TAM and a second throttle valve opening ratio TAS.

In traction control, when an accelerator pedal is abruptly pressed to increase the first throttle valve opening ratio TAM and realize an excessively large slip rate of wheels, the second throttle valve is closed to reduce the amount of air intake into an internal combustion engine. The corresponding single-valve opening ratio TAA for realizing the appropriate amount of air intake is calculated, and the second throttle valve opening ratio TAS to be controlled is then determined by referring to the map according to the corresponding single-valve opening ratio TAA and the first throttle valve opening ratio TAM actually measured. Such control practically restricts the first throttle valve opening ratio and uses a range FF shown in FIG. 1. In the range FF, the corresponding single-valve opening ratio TAA is substantially determined only by the second throttle valve opening ratio TAS. The structure of the map is thereby relatively simple in this range FF.

In a specific range in the vicinity of an area where the two parameters have a predetermined proportional relationship, for example, a range GG in FIG. 1, the target amount is significantly varied with variation in the two parameters. The map accordingly requires an extremely large data volume for realizing a certain precision.

When the map is referred in the range GG of FIG. 1, dense graduation of the map is required since the target amount is significantly varied with variation in either of the two parameters. Although a residual area other than the specific range GG does not require such dense graduations, a number of map points or map graduations can not be reduced in the residual area since the specific region GG extends around a line of TAM=TAS. When a range requiring dense graduations extends two-dimensionally, the map for determining a target amount according to two parameters should have dense graduations in the whole range.

Such a large map undesirably occupies a large space of a memory unit of a vehicle system where only a limited number of electronic devices are mounted. The large map requires a relatively long time to be referred to for determination of a target amount, thereby preventing quick control.

Some systems for shifting a mean value as an origin of a coordinate system for the purpose of reduction of a map volume storing learned values have been proposed as disclosed in JAPANESE PATENT LAYING-OPEN GAZETTE No. 61-190138. Such system, however, only reduces the bit number of data by converting absolute data to relative data, and can not reduce the volume of the map used for determining the target amount according to the two parameters in the relationship described above.

SUMMARY OF THE INVENTION

The object of the present invention is accordingly to reduce a data volume of a map used for determining a target amount according to two parameters without lowering precision of operation in an arithmetic unit for vehicles, a method of operation, and a throttle valve opening ratio computing device.

The present invention is directed to an arithmetic unit used for a vehicle system for determining a target amount according to two parameters related to control of an internal combustion engine by referring to a map MP as shown in FIG. 2A. The target amount is correlated with the two parameters so that, in a specific region in the vicinity of an area in which the two parameters have a predetermined proportional relationship, the target amount is significantly varied as either of the two parameters is varied. In a region other than the specific region, the target amount is fixed or is varied depending mainly upon only one of the parameters. The map MP represents a difference between the two parameters plotted against one of the two parameters to give a deviation between the target amount and the one parameter. A dense-data area of the map MP, in which the difference between the two parameters is densely graduated, is located within a range corresponding to the specific region in the vicinity of the area wherein the two parameters have the predetermined proportional The arithmetic unit of the invention includes:

memory M1 for storing the map MP to allow reference of the map MP, and target amount computing means M2 for, when the two parameters are input, determining the target amount according to the deviation and the one parameter obtained by referring to the map MP stored in the memory M1.

In the arithmetic unit of the invention thus constructed, the memory M1 stores the map MP representing the difference of two parameters plotted against one of the two parameters to give a deviation between a target amount and the one parameter, and having a dense-data area, wherein the difference between the two parameters is densely graduated, in a range corresponding to the specific region in the vicinity of the area where the two parameters have the predetermined proportional relationship. When the two parameters are input, the target amount computing means M2 determines the target amount according to the deviation and the one parameter obtained by referring to the map MP stored in the memory M1. The map MP has a dense-data area not in the whole range of the map but within a restricted range of the two-dimensional map.

The principle of the arithmetic unit according to the invention may be applied to a throttle valve opening ratio computing device for determining a corresponding single-valve opening ratio according to a first valve opening ratio of a first throttle valve and a second valve opening ratio of a second throttle valve in a dual-valve throttle unit arranged in series in an intake conduit of an internal combustion engine by referring to a map.

The map represents a difference of the first valve opening ratio and the second valve opening ratio plotted against one of the first and second valve opening ratios to give a deviation between the corresponding single-valve opening ratio and the one valve opening ratio, and has a dense-data area, wherein the difference between the first valve opening ratio and the second valve opening ratio is densely graduated in a range corresponding to a specific region in the vicinity of an area where the first valve opening ratio and the second valve opening ratio have a predetermined proportional relationship.

The throttle valve opening ratio computing device includes:

memory for storing the map to allow reference of the map; and corresponding single-valve opening ratio computing means for, when data of the first valve opening ratio and the second valve opening ratio are input, determining the corresponding single-valve opening ratio according to the deviation and the one valve opening ratio obtained by referring to the map stored in the memory.

Like the arithmetic unit, the throttle valve opening ratio computing device does not require dense graduations in the whole area of the map.

The invention is also directed to an operation method for determining a target amount as shown in FIG. 2B. The target amount is correlated with two parameters relating to the control of an internal combustion engine, significantly varied with variation of both the parameters in a specific region in the vicinity of an area where the two parameters have a predetermined proportional relationship, and fixed or varied depending mainly upon one of the two parameters in a region other than the specific region.

The method of the invention includes the steps of:

S0: storing a map MP in a memory representing a difference between the two parameters plotted against one of the two parameters to give a deviation between the target amount and the one parameter and having a dense-data area where the difference of the two parameters is densely graduated, in a range corresponding to the specific region in the vicinity of the area where the two parameters have the predetermined proportional relationship;

S1: applying to the map MP to determine the deviation when the two parameters are input; and

S2: determining the target amount based on the deviation.

In the operation method according to the invention, the map MP prepared at step S0 represents a difference of the two parameters plotted against one of the two parameters to give a deviation between the target amount and the one parameter and has a dense-data area, where the difference of the two parameters is densely graduated, in a range corresponding to the specific region in the vicinity of the area where the two parameters have the predetermined proportional relationship. When the two parameters are input, the deviation between the target amount and the one parameter is determined by applying to the map MP at step S1. The target amount is then determined according to the deviation at step S2.

In the arithmetic unit, the throttle valve opening ratio computing device, and the operation method according to the invention, the map MP is used for determining a target amount. The target amount is correlated to two parameters relating to the control of the internal combustion engine (first and second valve opening ratios), significantly varied with variation of both the parameters in a specific region in the vicinity of an area where the two parameters have a predetermined proportional relationship, and fixed or varied depending mainly upon one of the two parameters in a region other than the specific region. The map MP has a dense-data area having dense graduations only in a required area. This effectively reduces the data volume of the map.

These and other objects, features, aspects, and advantages of the present invention will become more apparent from the following detailed description of the preferred embodiments with the accompanying drawings.

DESCRIPTION OF THE PREFERRED EMBODIMENT

Figure 3:
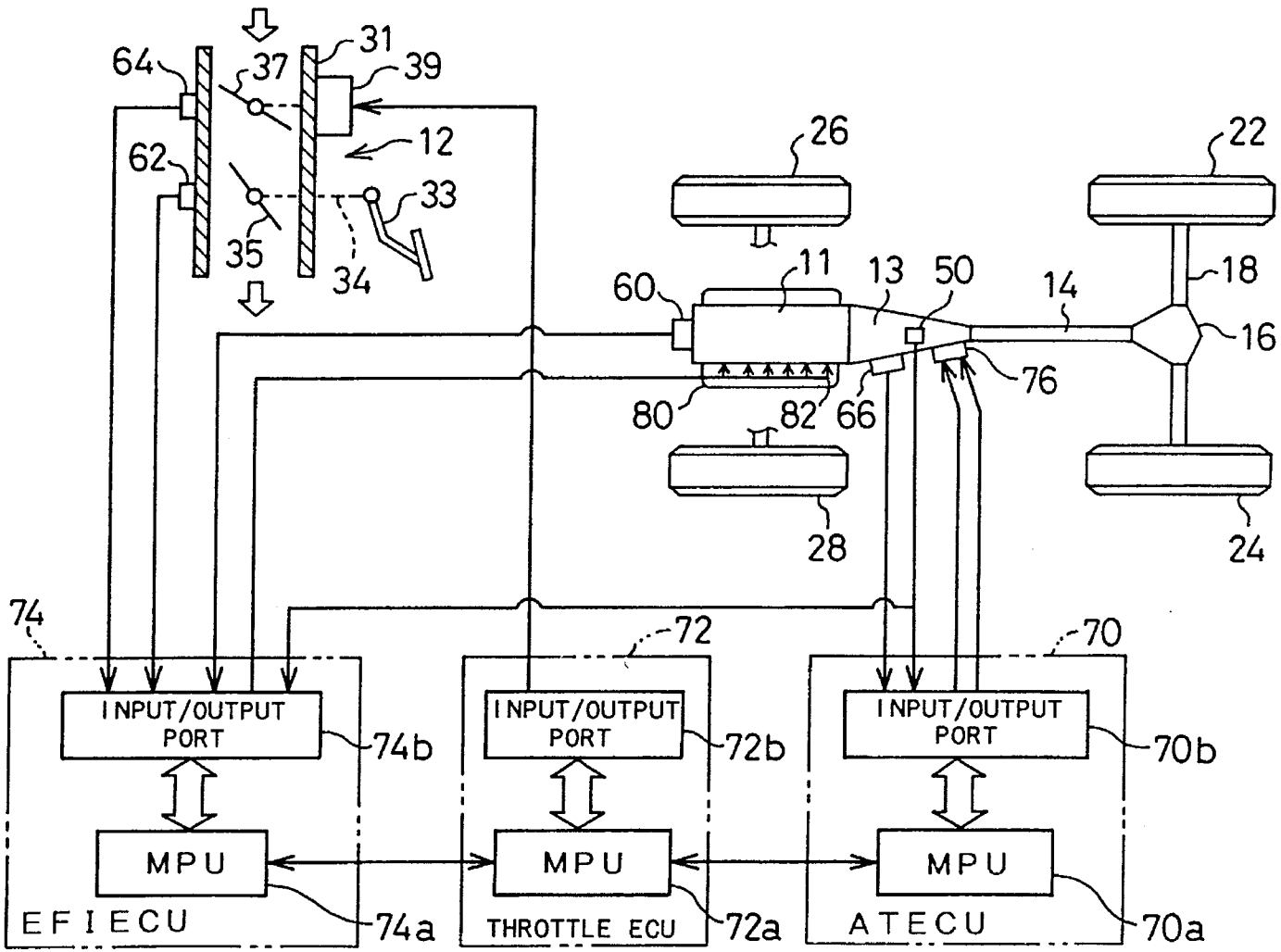
FIG. 3 schematically illustrates a vehicle system having an arithmetic unit incorporated therein as one embodiment of the invention.

The structure and function of the invention will become more apparent through description of a preferred embodiment according to the invention. FIG. 3 schematically illustrates a vehicle system having an arithmetic unit incorporated therein as one embodiment of the invention. This vehicle system electronically implements fuel injection control of an engine 11, total control of air intake, and control of an automatic transmission.

As shown in FIG. 3, the vehicle includes the engine 11 where the amount of fuel injection is controlled electronically, a dual-valve throttle unit 12 for adjusting the amount of air intake into the engine 11, an automatic transmission disposed between the engine 11 and a drive shaft 14 for shifting the gear to a desired gear ratio, and three electronic control units (hereinafter referred to as ECU) 70, 72, and 74 for controlling these elements. The rotational driving force of the engine 11 gear-shifted by the automatic transmission 13 is transmitted to a right rear wheel 22 and a left rear wheel 24 via the propeller shaft 14, a rear differential gear 16, and a rear drive shaft 18. A right front wheel 26 and a left front wheel 28 function as idler wheels.

Figure 4:
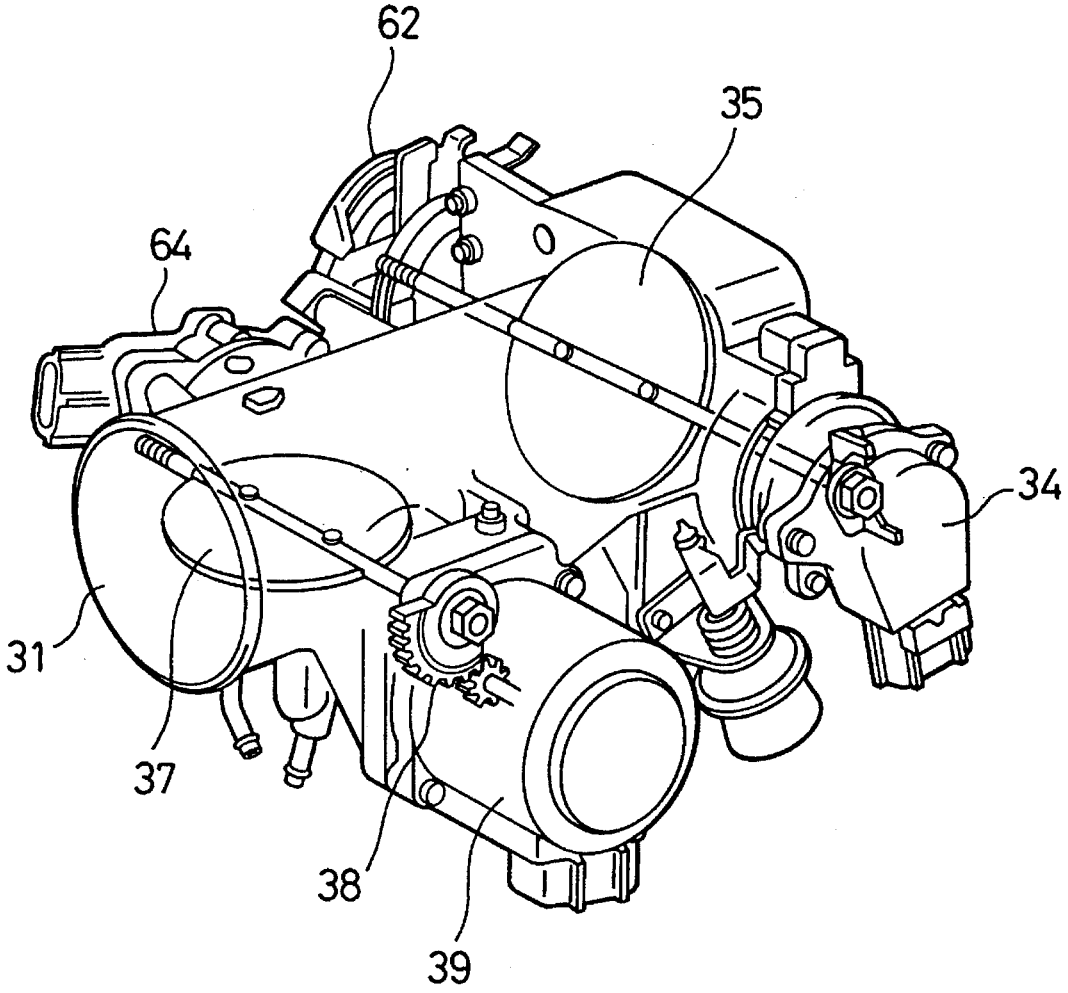
FIG. 4 is a perspective view illustrating a structure of the dual-valve throttle unit 12.

Referring to FIGS. 3 and 4, the dual-valve throttle unit 12 is formed on an intake pipe 31 of the engine 11, and includes a main throttle valve 35 connected to an accelerator pedal 33 via a mechanical link 34, and a sub-throttle valve 37 disposed upstream of the main throttle valve 35. The sub-throttle valve 37 is driven by a throttle actuator 39 via a reduction gear 38. The sub-throttle valve 37 is pressed towards a full-open position by a spring (not shown).

A system applied for total vehicle control is provided with a variety of sensors for detecting driving conditions as shown in FIG. 3, which include a speed sensor 50 for detecting the rotating speed of an output shaft of the automatic transmission 13, a crank angle sensor 60 for detecting the speed of the engine 11, a main throttle position sensor 62 for detecting the valve opening ratio of the main throttle valve 35, a sub-throttle position sensor 64 for detecting the valve opening ratio of the sub-throttle valve 37, and a position sensor 66 for detecting a gear shift position of the automatic transmission 13.

The three ECUs include the electronic control unit for automatic transmission control (hereinafter referred to as ATECU) 70, the electronic control unit for sub-throttle control (hereinafter referred to as the throttle ECU) 72, and the electronic control unit for engine control (hereinafter referred to as EFIECU) 74. These ECUs 70, 72, and 74 receive signals transmitted from the variety of sensors described above. The EFIECU 74, for example, receives signals transmitted from the crank angle sensor 60, the main throttle position sensor 62, and the sub-throttle position sensor 64.

The ATECU 70 and the throttle ECU 72 are connected to each other to allow mutual serial communication and data transmission whereas the throttle ECU 72 and the EFIECU 74 are connected in the same manner. The throttle ECU 72 receives data representing a first valve opening ratio TAM of the main throttle valve 35 and a second valve opening ratio TAS of the sub-throttle valve 37 from the EFIECU 74 while the ATECU 70 receives data representing a corresponding single-valve opening ratio TAA of the throttle valve unit 12 from the throttle ECU 72.

The ATECU 70 for controlling upshift and downshift of the automatic transmission 13 includes a 1-chip micro processor unit (hereinafter referred to as MPU) **70*a* having a ROM, a RAM, and a serial communication circuit built therein for executing controls based on programs registered in the ROM, and an input/output port 70*b*** working as an interface for external units and the variety of sensors.

The MPU **70*a* receives data representing the vehicle speed and the rotating speed of the engine 11 via the input/output port 70*b*, and drives a plurality of gear-shift and lock-up solenoids 76 built in the automatic transmission 13 for upshift or downshift of the automatic transmission 13** or lock-up control of a torque converter (not shown) so as to realize an optimal gear shift position.

The EFIECU 74 for controlling the fuel injection of the engine 11 includes, like the ATECU 70, an MPU **74*a* and an input/output port 74*b* working as an interface for the variety of sensors. The MPU 74*a* receives data representing a vehicle speed V, an engine speed NE, the first valve opening ratio TAM of the main throttle valve 35, the second valve opening ratio TAS of the sub-throttle valve 37, and a manifold negative pressure PM from an intake pipe pressure sensor (not shown), and determines the amount of fuel injection based on these data for optimal fuel injection control. In other words, the MPU 74*a* determines the amount of fuel injection required for the engine 11 and controls a valve opening time of a fuel injection valve 82 formed on an intake manifold 80** for optimal fuel injection control.

The throttle ECU 72 for controlling the valve opening ratio of the sub-throttle valve 37 includes, like the ATECU 70 and the EFIECU 74, an MPU **72*a* and an input/output port 72*b* working as an interface for the throttle actuator 39. The throttle ECU 72 controls the second valve opening ratio TAS of the sub-throttle valve 37 to restrict operation of the accelerator pedal 33, that is, to restrict an amount of air intake into the engine 11, which is generally determined in a uniform manner according to the first valve opening ratio TAM of the main throttle valve 35, to a value suitable for driving conditions of the vehicle. This allows the output of the engine 11 and thereby the driving force transmitted to the rear wheels 22 and 24** to be controlled appropriately.

Figure 5:
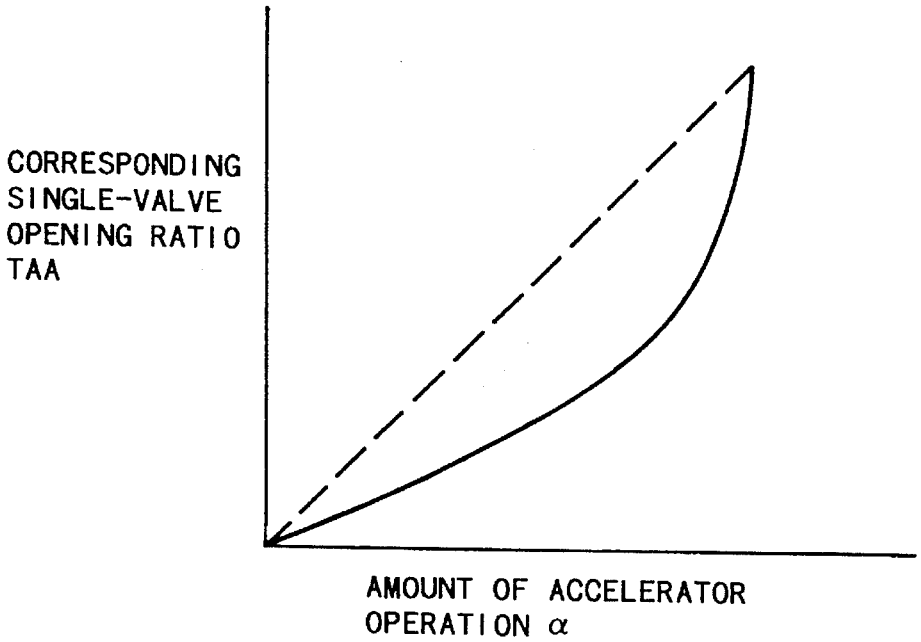
FIG. 5 is a graph showing the relationship between the amount of accelerator operation $\alpha$ and the corresponding single-valve opening ratio TAA.
Figure 6:
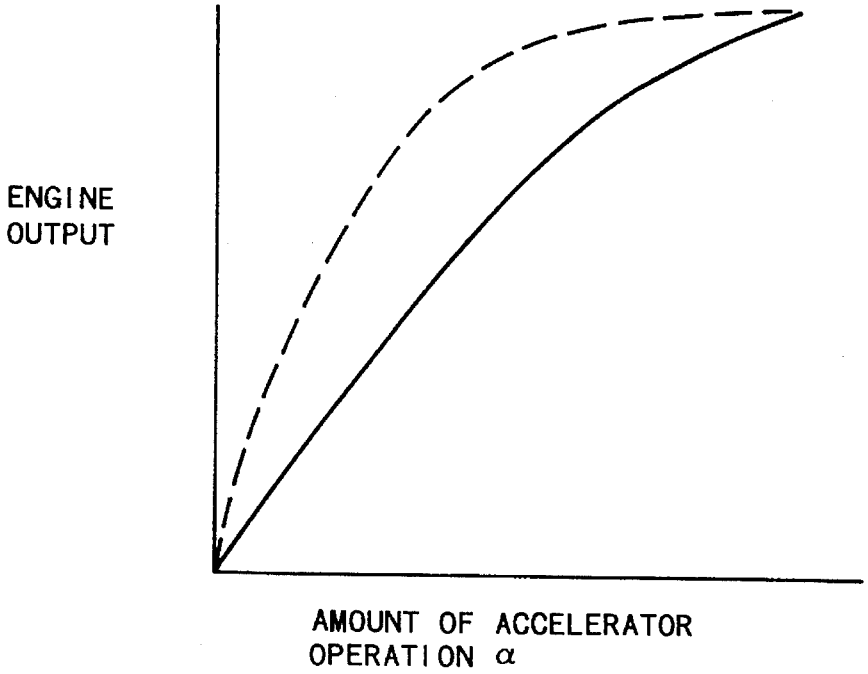
FIG. 6 is a graph showing the relationship between the amount of accelerator operation $\alpha$ and the engine output.

The throttle ECU 72 changes the corresponding single-valve opening ratio TAA of the dual-valve throttle unit 12 with respect to the amount of accelerator operation $\alpha$ from a conventional proportional relationship shown by the broken line in FIG. 5 to a freely set relationship shown as an example by the solid line in FIG. 5. As a result, the final engine output shows a relatively uniform variation in all operation areas of the accelerator pedal 33 as shown by the solid line in FIG. 6, compared with the conventional relationship having a large variation in an area (general area) having the smaller operation amount of the acceleration pedal 33 and a small variation in an area having the larger operation amount of the acceleration pedal 33 shown by the broken line in FIG. 6. The relationships shown in FIGS. 5 and 6 represent only some examples. The output of the engine 11 with respect to the operation amount of the accelerator pedal 33 can freely be determined by detecting the first valve opening ratio TAM of the main throttle valve 35 by the main throttle position sensor 62 and setting the second valve opening ratio TAS of the sub-throttle valve 37 according to the first valve opening ratio TAM.

The throttle ECU 72 determines the corresponding single-valve opening ratio TAA currently realized by the dual-valve throttle unit 12 based on the current first valve opening ratio TAM of the main throttle valve 35 and the current second valve opening ratio TAS of the sub-throttle valve 37, and outputs the corresponding single-valve opening ratio TAA to the ATECU 70. Determination of the corresponding single-valve opening ratio TAA is executed according to the operation method of the present invention whereas a hardware system for executing the operation corresponds to the arithmetic unit of the present invention. The operation is explained according to the flowchart of FIG. 7.

Figure 7:
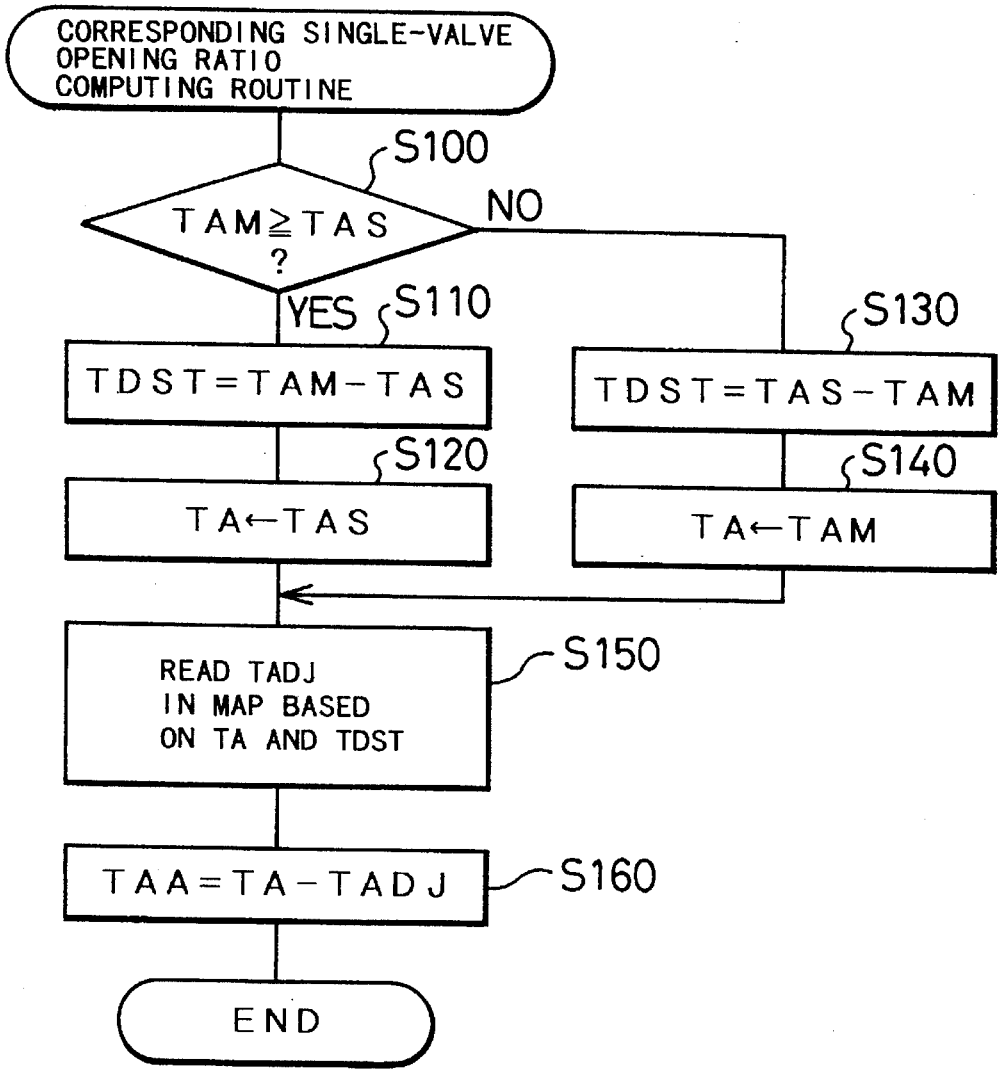
FIG. 7 is a flowchart showing a corresponding single-valve opening ratio calculation routine executed in the embodiment.

An operation routine for determining the corresponding single-valve opening ratio TAA shown in FIG. 7 starts when the first valve opening ratio TAM of the main throttle valve 35 or the second valve opening ratio TAS of the sub-throttle valve 37 is changed. When the program enters the routine, the first valve opening ratio TAM of the main throttle valve 35 is compared with the second valve opening ratio TAS of the sub-throttle valve 37 at step S100. The first valve opening ratio TAM of the main throttle valve 35 and the second valve opening ratio TAS of the sub-throttle valve 37 are input from the EFIECU 74 through communication and stored in a predetermined region of an internal RAM.

When the first valve opening ratio TAM of the main throttle valve 35 is determined to be equal to or greater than the second valve opening ratio TAS of the sub-throttle valve 37 at step S100, the program proceeds to step S110 at which the throttle ECU 72 subtracts the second valve opening ratio TAS of the sub-throttle valve 37 from the first valve opening ratio TAM of the main throttle valve 35 to determine a difference TDST. At the subsequent step S120, the second valve opening ratio TAS of the sub-throttle valve 37 smaller than the first valve opening ratio TAM of the main throttle valve 35 is stored as a restriction value TA.

When the first valve opening ratio TAM of the main throttle valve 35 is determined to be smaller than the second valve opening ratio TAS of the sub-throttle valve 37 at step S100, on the other hand, the program goes to step S130 at which the throttle ECU 72 subtracts the first valve opening ratio TAM of the main throttle valve 35 from the second valve opening ratio TAS of the sub-throttle valve 37 to determine a difference TDST. At the subsequent step S140, the first valve opening ratio TAM of the main throttle valve 35 smaller than the second valve opening ratio TAS of the sub-throttle valve 37 is stored as a restriction value TA. The restriction value TA accordingly corresponds to the smaller of the first valve opening ratio TAM of the main throttle valve 35 and the second valve opening ratio TAS of the sub-throttle valve 37. This is expressed as the equation TA=MIN(TAM, TAS). The smaller value TA is called the restriction value since one of the valves having the smaller valve opening ratio restricts the amount of air intake.

The program then goes to step S150 at which a deviation TADJ is determined according to the restriction value TA and the difference TDST by referring to a map. At the subsequent step S160, the throttle ECU 72 determines the corresponding single-valve opening ratio TAA by subtracting the deviation TADJ from the restriction value TA.

Figure 1:
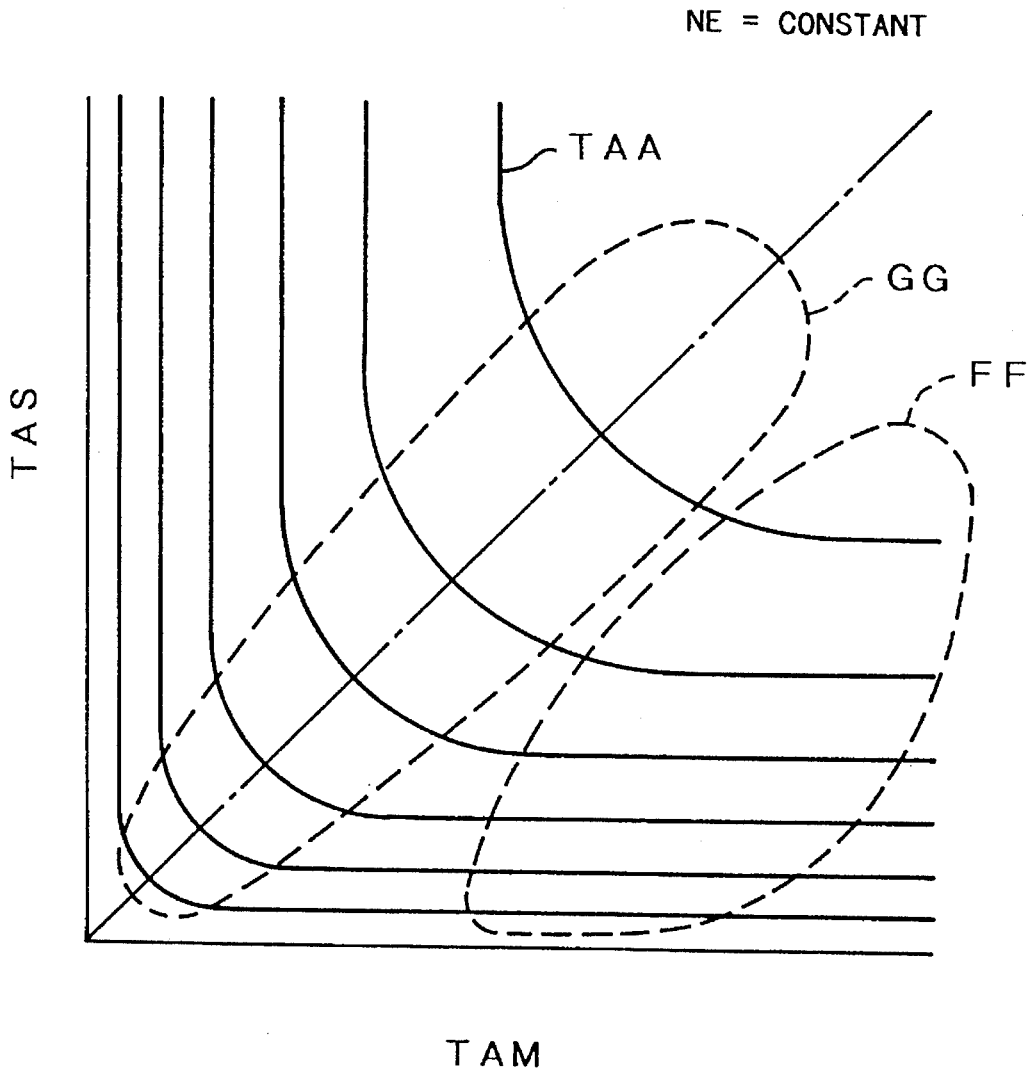
FIG. 1 is a graph showing a map representing the correlation of a corresponding single-valve opening ratio TAA with a first throttle valve opening ratio TAM and a second throttle valve opening ratio TAS.
Figure 2A:
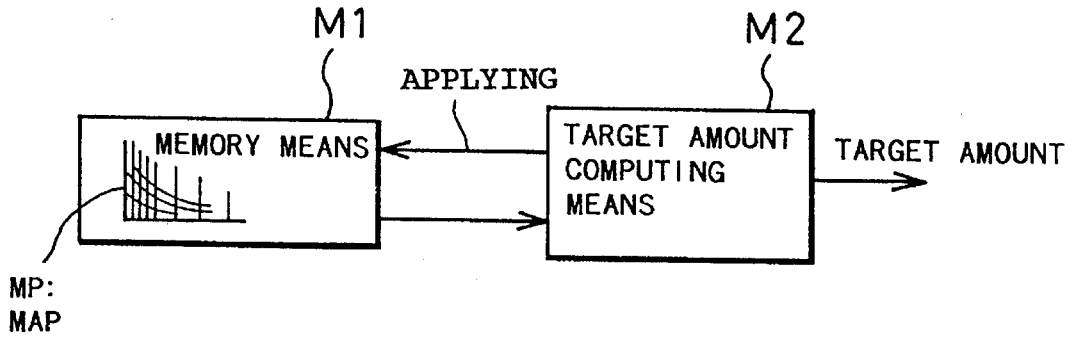
FIGS. 2A and 2B show a fundamental structure of the present invention.
Figure 2B:
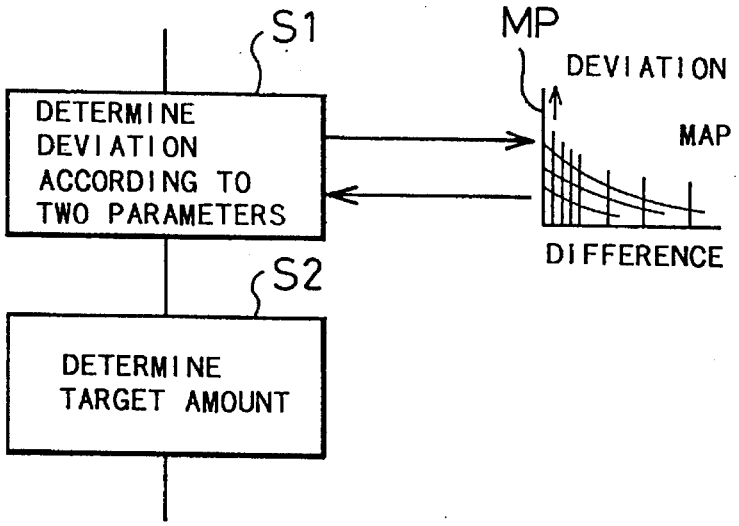

The map referred to at step S150 is described in detail. FIG. 1 is a graph showing an original map representing the correlation of the corresponding single-valve opening ratio TAA with the valve opening ratio of the main throttle valve 35 and the second valve opening ratio TAS of the sub-throttle valve 37 in the dual-valve throttle unit 12 under conditions of a constant rotating speed NE of the engine 11 as described previously. The corresponding single-valve opening ratio TAA represents the amount of air intake by the dual-valve throttle unit 12 converted into the valve opening ratio of a single-valve type throttle valve. The corresponding single-valve opening ratio TAA is strongly affected by the smaller valve opening ratio TAM or TAS of the main throttle valve 35 or the sub-throttle valve 37. When one valve opening ratio is extremely smaller than the other valve opening ratio, the corresponding single-valve opening ratio TAA is substantially determined by the smaller valve opening ratio. When both the valve opening ratios are relatively close to each other, the corresponding single-valve opening ratio TAA significantly depends upon both the valve opening ratios. Even a small variation in one of the valve opening ratios thus significantly changes the corresponding single-valve opening ratio TAA.

An area where the first valve opening ratio TAM of the main throttle valve 35 is close to the second valve opening ratio TAS of the sub-throttle valve 37 exists around the line of TAM=TAS. When this map shown in FIG. 1 is stored in the ROM of the throttle ECU 72, data are required for the whole area of the first valve opening ratio TAM of the main throttle valve 35 and the second valve opening ratio TAS of the sub-throttle valve 37.

Figure 8:
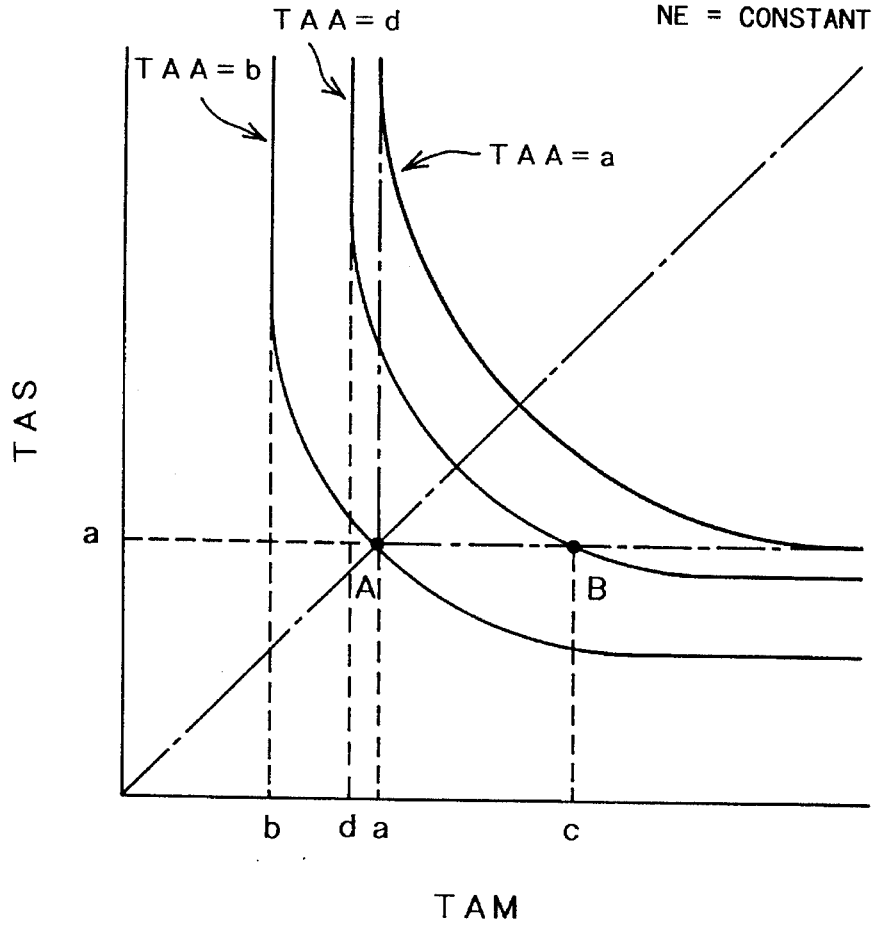
FIG. 8 is a graph where additional lines are drawn to the original map of FIG. 1 for creation of a new map based on the original map.
Figure 9:
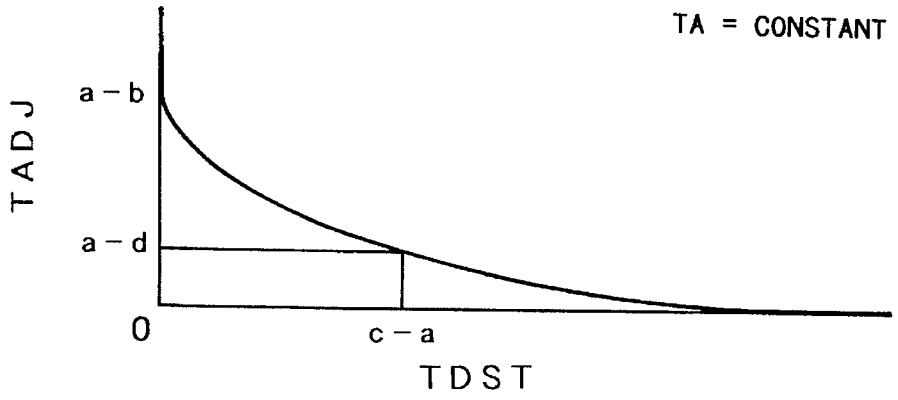
FIG. 9 schematically shows a new two-dimensional map used in the embodiment.

In this embodiment, a two-dimensional map is accordingly prepared in place of the original map of FIG. 1 and stored in the ROM of the throttle ECU 72. The two-dimensional map shows an absolute value of the difference TDST (=|TAM-TAS|) between the first valve opening ratio TAM of the main throttle valve 35 and the second valve opening ratio TAS of the sub-throttle valve 37 plotted against the restriction value TA =MIN(TAM, TAS), which is the smaller of the first valve opening ratio TAM of the main throttle valve 35 and the second valve opening ratio TAS of the sub-throttle valve 37. FIG. 8 is a graph where additional lines are drawn to the original map of FIG. 1 for creation of the two-dimensional map based on the original map. FIG. 9 schematically shows the two-dimensional map thus created.

The corresponding single-valve opening ratio TAA is rewritten as:

$$TAA=TAM-(TAM-TAA) \quad (1)$$

The equation (1) is further rewritten as:

$$TAA=TAM-TADJ \quad (2)$$

where TADJ=TAM–TAA. The graph shown in FIG. 8 is symmetrical with respect to the line of TAM=TAS; that is, TAM and TAS are interchangeable. According to such relationship, the equation (2) can be expressed as follows by substituting the restriction value TA for the first valve opening ratio TAM of the main throttle valve 35 and the second valve opening ratio TAS of the sub-throttle valve 37:

$$TAA=TA-TADJ \quad (3)$$

In FIG. 8, at a point A where TAM=TAS=a, the corresponding single-valve opening ratio TAA is equal to a value b whereas the restriction value TA is equal to the value a. The equation (3) is rewritten as b=a–TADJ by substituting these values a and b in the equation (3). This means that TADJ is equal to (a–b) when TDST is equal to zero. A map point defined by the restriction value TA=a and the absolute value TDST=0 is given in the graph of FIG. 9.

Figure 10:
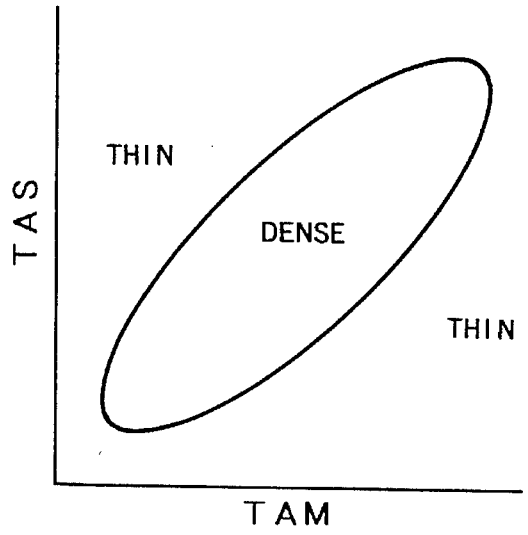
FIG. 10 shows an area requiring a high precision in the original map.
Figure 11A:
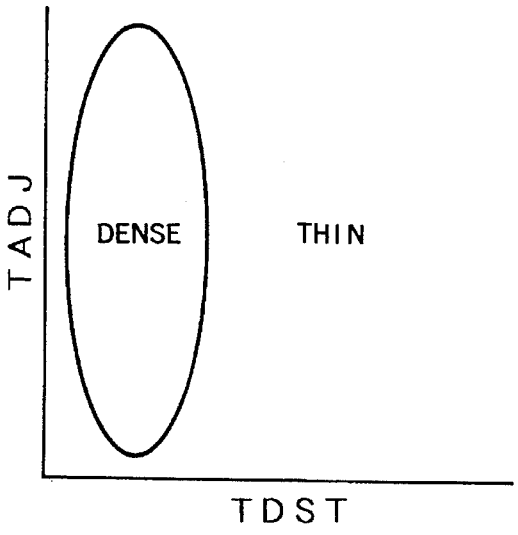
FIGS. 11A and 11B show an area requiring a high precision in the new map.

The same procedures are repeated for other points having the same restriction value TA. At a point B in FIG. 8, for example, the absolute value TDST is equal to (c–a) and the deviation TADJ is equal to (a–d). This point is also given as another map point in FIG. 9. After the graph is drawn under the condition of the constant restriction value TA=a, the two-dimensional map is completed by successively varying the restriction value TA. An area in the vicinity of the line TAM=TAS in FIG. 8, that is, an area requiring a high precision, is shifted to an area in the vicinity of the ordinate (TDST=0) as clearly seen in FIGS. 10 and 11A. In the graphs of FIGS. 10 and 11A, 'dense' represents an area requiring detailed data due to significant variation in the corresponding single-valve opening ratio TAA with changes of the first valve opening ratio TAM of the main throttle valve 35 and the second valve opening ratio TAS of the sub-throttle valve 37 whereas 'thin' represents an area not requiring detailed data since the corresponding single-valve opening ratio TAA depends substantially only upon one of the valve opening ratios.

Figure 11B:
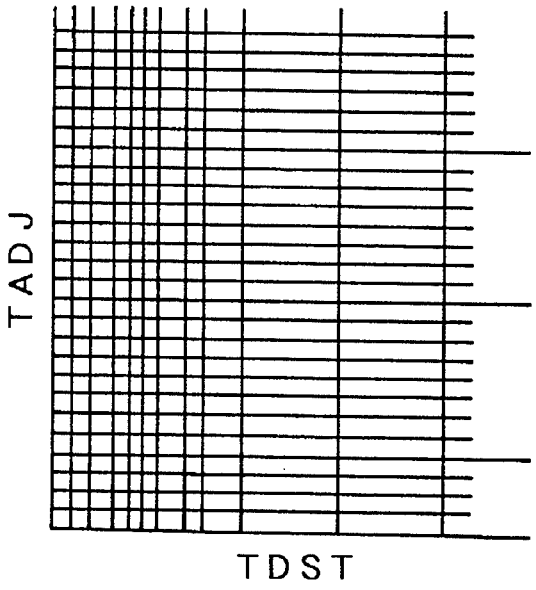

The graduations of the map thereby become sparse with the larger absolute value TDST as shown in FIG. 11B. This efficiently reduces the total data volume and the number of divisions in the map. The smaller number of divisions in the map reduces the number of comparisons where values on both sides of each division are compared with each other, thus allowing quick reference of the map.

After the deviation TADJ is read from the map, the corresponding single-valve opening ratio TAA is determined according to the equation (3). The throttle ECU 72 outputs the corresponding single-valve opening ratio TAA through communication to the ATECU 70, which receives the corresponding single-valve opening ratio TAA and reduces the shock due to gear-shift based on the corresponding single-valve opening ratio TAA. Other ECUs may also utilize the corresponding single-valve opening ratio TAA.

As described above, the operation method or the throttle valve opening ratio computing device of the embodiment determines the corresponding single-valve opening ratio TAA with the required precision in operation, thereby significantly reducing the volume of the map stored in the ROM and shortening the time period required for reference of the map. The small map reduces time and labor required for updating and maintenance of the map.

Other embodiments according to the invention are described briefly. In the above embodiment, the map of FIG. 9 representing the absolute value TDST plotted against the deviation TADJ to have the data volume half that of the original map is drawn by utilizing the symmetrical features of the graph of FIG. 1. When the graph is unsymmetrical, however, it is practical to plot as abscissa the difference between the first valve opening ratio TAM of the main throttle valve 35 and the second valve opening ratio TAS of the sub-throttle valve 37 and to use either of the valve opening ratios TAM and TAS as a parameter.

Figure 12A:
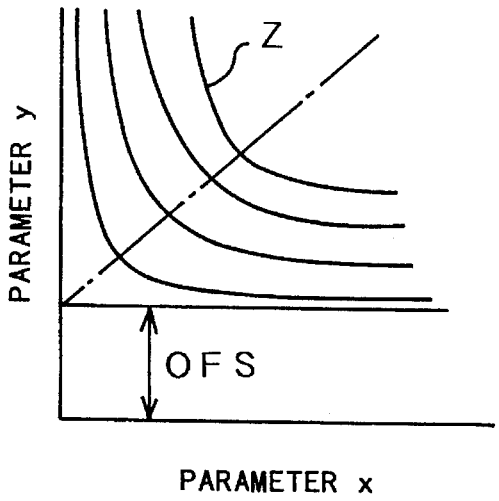
FIGS. 12A and 12B show an original map shifted in the direction of the ordinate by a predetermined amount and a corresponding new map.
Figure 12B:
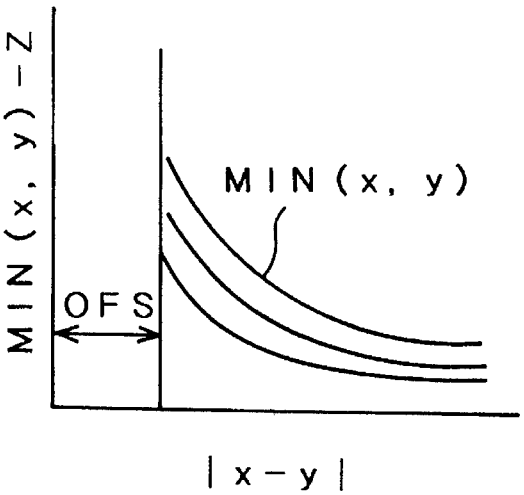
Figure 13:
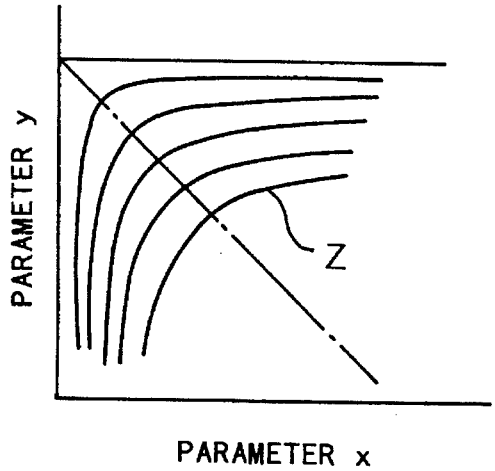
FIG. 13 is a graph showing another map drawn in a different direction.
Figure 14A:
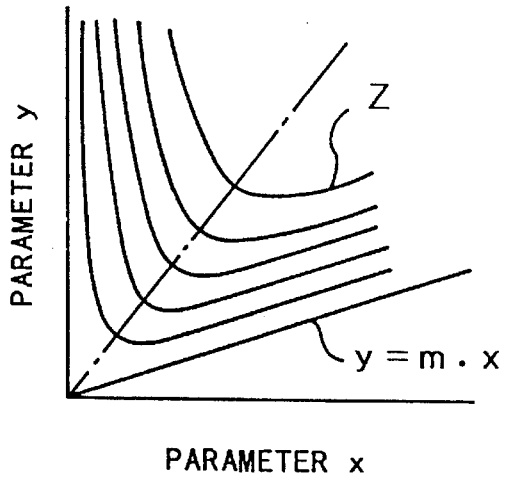
FIG. 14A and 14B show application to another map.
Figure 14B:
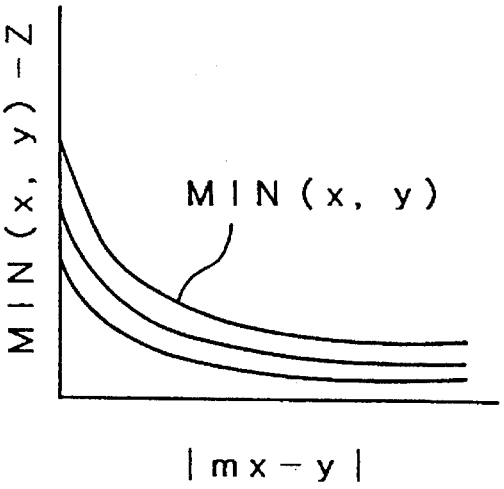

When the original map referred to is shifted in the direction of the ordinate by an off-set value OFS as shown in FIG. 12A, a new map drawn by the same procedures as the above embodiment has a dense-data area shifted corresponding to the off-set value OFS as shown in FIG. 12B. The same principle is applicable to a map drawn in a different direction as shown in FIG. 13. As shown in FIG. 14A, when the original map drawn with respect to the line of $y=m\cdot x$ as abscissa has the similar relationship to that of the above embodiment, the abscissa of the converted map should be set as $(m\cdot x-y)$ in place of $(x-y)$ as shown in FIG. 14B. This allows an area requiring a high precision to be placed in a certain range with respect to the abscissa.

There may be many other modifications, alternations, and changes without departing from the scope or spirit of essential characteristics of the invention. It is thus clearly understood that the above embodiments are only illustrative and not restrictive in any sense. The principle of the invention is applicable to operations other than calculation of the corresponding single-valve opening ratio TAA; for example, operation utilizing the relationship between the first valve opening ratio TAM of the main throttle valve 35, the second valve opening ratio TAS of the sub-throttle valve 37, and the manifold negative pressure PM, operation utilizing the relationship between the first valve opening ratio TAM of the main throttle valve 35, the second valve opening ratio TAS of the sub-throttle valve 37, and the output torque TRQ of the engine, and operation with parameters having the hyperbolic function.

The scope and spirit of the present invention are limited only by the terms of the appended claims.

What is claimed is:

1. An arithmetic unit for determining a target amount to which an engine operating parameter is to be set based on a map, wherein the target amount stored in the map is based on a first and a second detected engine operating condition and wherein, under a first engine running state, the first and second engine operating conditions are proportionally related and the target amount varies upon a change in either of the first and second engine operating conditions and wherein, when the engine is not operating under the first running state, the target amount is not substantially effected by a change in the first engine operating condition, wherein:

the map represents a difference between the first and second engine operating conditions plotted against a range of values, wherein the range of values represents a range of possible values for both the first and second engine operating conditions, to give a deviation between the target amount and the value of one of the first and second engine operating conditions;

wherein the map has a dense-data area in which the difference between the first and second engine operating conditions is densely graduated, the dense-data area being in a range corresponding to the first engine running state;

wherein the arithmetic unit includes:

memory for storing the map; and target amount computing means for referring to the map stored in the memory to determine, when the first and second engine operating conditions are input, the target amount according to the deviation between the target amount and the value of the selected one of the first and second engine operating conditions.

2. An arithmetic unit in accordance with claim 1, wherein the first and second engine operating conditions are expressed as X and Y, respectively, and are symmetrical with respect to a line of X=Y, wherein:

the map stored in the memory represents an absolute value of the difference between the first and second engine operating conditions and wherein the smaller of the first and second engine operating conditions is employed as the selected one of the first and second engine operating conditions to give a deviation between the target amount and the smaller of the first and second engine operating conditions.

3. An arithmetic unit in accordance with claim 1, wherein the memory for storing the map comprises a ROM allowing data to be read and output by specifying an address in the ROM.

4. A throttle valve opening amount computing device for determining, by referring to a map, an equivalent single-valve opening amount corresponding to a first valve opening amount of a first throttle valve and a second valve opening amount of a second throttle valve in a dual-valve throttle unit arranged in an intake conduit of an internal combustion engine, wherein:

the map represents a difference between the first valve opening amount and the second valve opening amount plotted against values which represent one of the first and second valve opening amounts to give a deviation between the equivalent single-valve opening amount and the values which represent the one valve opening amount, wherein the map has a dense-data area in which the difference between the first valve opening amount and the second valve opening amount is densely graduated and wherein the dense-data area is located in a range in which the first valve opening amount and the second valve opening amount are proportionally related, wherein the computing device comprises:

memory for storing the map; and equivalent single-valve opening amount computing means for determining, when the first valve opening amount and the second valve opening amount are input, an equivalent single-valve opening amount corresponding to the deviation and the one valve opening amount obtained by referring to the map stored in the memory.

5. A throttle valve opening amount computing device in accordance with claim 4, wherein the first valve opening amount and the second valve opening amount of the dual-valve throttle unit are interchangeable in operation for determining the equivalent single-valve opening amount, the map representing an absolute value of the difference between the first and second valve opening amounts plotted against values which are selected to represent the smaller of the first and second valve opening amounts to give a deviation between the equivalent single-valve opening amount and the smaller valve opening amount, the equivalent single-valve opening ratio computing means determining the equivalent single-valve opening amount according to the deviation and the smaller valve opening amount obtained by referring to the map stored in the memory when data of the first valve opening amount and the second valve opening amount are input.

6. A throttle valve opening amount computing device in accordance with claim 4, the computing device further comprising:

a first control unit connected to a first sensor for detecting the first valve opening amount and to a second sensor for detecting the second valve opening amount, the first control unit reading the first and second valve opening amounts to control driving conditions of the internal combustion engine; and a second control unit coupled to the first control unit, the second control unit comprising a ROM for storing the map and the equivalent single-valve opening amount and the second valve opening ratio transmitted from the first control unit.

7. A throttle valve opening amount computing device in accordance with claim 4, the computing device further comprising:

output means for outputting the equivalent single-valve opening amount to a gear control unit for controlling a shift of a gear coupled to an output shaft of the internal combustion engine based on a rotating speed of the internal combustion engine and the equivalent single-valve opening amount.

8. A throttle valve opening amount computing device in accordance with claim 4, wherein:

the first throttle valve of the dual-valve throttle unit is directly connected to an accelerator pedal; and the second throttle valve is coupled to a unit for controlling the second valve opening amount based on the first valve opening amount.

9. A method for determining a target amount to which an engine operating parameter is to be set based on a map, wherein the target amount stored in the map is based on a first and a second detected engine operating condition and wherein, under a first engine running state, the first and second engine operating conditions are proportionally related and the target amount varies upon a change in either of the first and second engine operating conditions and wherein, when the engine is not operating under the first running state, the target amount is not substantially effected by a change in the first engine operating condition, the method comprising the steps of:

storing a map in a memory, wherein the map represents a difference between the first and second engine operating conditions plotted against values which represent one of the first and second engine operating conditions to give a deviation between the target amount and the one engine operating condition, the map having a dense-data area in which the difference between the first and second engine operating conditions is more densely graduated than in other areas of the map, wherein the dense-data area corresponds to the first engine running state;

applying the map to determine the deviation when the first and second operating conditions are input; and determining the target amount based on the deviation.

10. A method in accordance with claim 9, wherein one of the first and second engine operating conditions is represented by a value obtained by transforming a coordinate system for a physical amount actually detected, wherein the method further comprising the steps of:

storing the map in a memory to represent a relationship between the two parameters after transformation of the coordinate system;

applying the map to determine the deviation after the coordinate system is transformed for the physical amount actually detected; and determining the target amount based on the deviation.

* * * * *

UNITED STATES PATENT AND TRADEMARK OFFICE

CERTIFICATE OF CORRECTION

PATENT NO. : 5,541,844

DATED : July 30, 1996

INVENTOR(S) : Toshikazu IBARAKI et al.

It is certified that error appears in the above-indentified patent and that said Letters Patent is hereby corrected as shown below:

| Column | Line | |
|---|---|---|
| 2 | 54 | After "proportional" insert --relationship--. |
| 3 | 67 | After "difference" change "of" to --between--. |
| 5 | 24 | Change "propeller shaft" to --drive shaft-- |

Signed and Sealed this

Twenty-sixth Day of November 1996

*Attest:*

*Attesting Officer*

BRUCE LEHMAN

*Commissioner of Patents and Trademarks*